US008696311B2

(12) United States Patent
Eleftheriou et al.

(10) Patent No.: US 8,696,311 B2
(45) Date of Patent: Apr. 15, 2014

(54) APPARATUS AND METHOD FOR GAS TURBINE ENGINE VANE RETENTION

(75) Inventors: Andreas Eleftheriou, Woodbridge (CA); Richard Ivakitch, Toronto (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 489 days.

(21) Appl. No.: 13/074,295

(22) Filed: Mar. 29, 2011

(65) Prior Publication Data

US 2012/0251313 A1 Oct. 4, 2012

(51) Int. Cl.
*F03B 1/00* (2006.01)

(52) U.S. Cl.
USPC ..... 415/209.4

(58) Field of Classification Search
USPC ..... 415/209.4, 119, 189, 190, 191, 209.2, 415/209.3
See application file for complete search history.

(56) References Cited

U.S. PATENT DOCUMENTS

| | | | | |
|---|---|---|---|---|
| 2,914,300 | A | 11/1959 | Sayre | |
| 3,393,436 | A | 7/1968 | Blackhurst et al. | |
| 3,428,244 | A | 2/1969 | Palmer | |
| 3,501,247 | A | 3/1970 | Tournere | |
| 3,749,512 | A | 7/1973 | Miller et al. | |
| 3,849,023 | A | 11/1974 | Klompas | |
| 3,985,465 | A | 10/1976 | Sheldon et al. | |
| 3,997,280 | A | 12/1976 | Germain | |
| 4,140,433 | A | 2/1979 | Eckel | |
| 4,180,371 | A | 12/1979 | Ivanko | |
| 4,305,696 | A | 12/1981 | Pask | |
| 4,378,961 | A | 4/1983 | Trousdell | |
| 4,655,682 | A | 4/1987 | Kunz et al. | |
| 4,728,258 | A | 3/1988 | Blazek et al. | |
| 4,820,120 | A | 4/1989 | Feuvrier et al. | |
| 4,820,124 | A | 4/1989 | Fried | |
| 4,859,143 | A | 8/1989 | Larrabee et al. | |
| 4,907,944 | A | 3/1990 | Kroger et al. | |
| 4,940,386 | A | 7/1990 | Feuvrier et al. | |
| 5,074,749 | A | 12/1991 | Fouillot et al. | |
| 5,074,752 | A | 12/1991 | Murphy et al. | |
| 5,181,827 | A | 1/1993 | Pellow et al. | |
| 5,269,649 | A | 12/1993 | Kiefer et al. | |
| 5,399,069 | A | 3/1995 | Marey et al. | |
| 5,494,404 | A * | 2/1996 | Furseth et al. | 415/209.3 |
| 5,547,342 | A | 8/1996 | Furseth et al. | |
| 5,569,019 | A | 10/1996 | Katariya et al. | |
| 5,690,469 | A | 11/1997 | Deal et al. | |
| 5,765,993 | A | 6/1998 | Weiss | |

(Continued)

FOREIGN PATENT DOCUMENTS

| | | |
|---|---|---|
| CA | 840224 | 4/1970 |
| EP | 1076159 | 2/2001 |

(Continued)

*Primary Examiner* — Edward Look
*Assistant Examiner* — William Grigos
(74) *Attorney, Agent, or Firm* — Norton Rose Fulbright Canada LLP (PWC)

(57) ABSTRACT

A vane assembly of a gas turbine engine has a plurality of vanes extending radially and inwardly from an annular casing. An outer end of each vane radially and outwardly projects from the casing and is received in one of apertures defined in an elastomeric ring which is placed around the casing. A strap of a non-metallic material is placed in a pre-tensioned condition around the elastomeric ring to compress the elastomeric ring and to radially retain the outer end of each vane.

16 Claims, 4 Drawing Sheets

(56) References Cited

U.S. PATENT DOCUMENTS

| | | | | |
|---|---|---|---|---|
| 6,196,794 | B1 | 3/2001 | Matsumoto | |
| 6,409,472 | B1 | 6/2002 | McMahon et al. | |
| 6,494,677 | B1 | 12/2002 | Grady | |
| 6,543,995 | B1 | 4/2003 | Honda et al. | |
| 6,595,747 | B2 | 7/2003 | Bos | |
| 6,619,917 | B2 | 9/2003 | Glover et al. | |
| 6,854,960 | B2 | 2/2005 | Van Dine et al. | |
| 7,195,452 | B2 | 3/2007 | Allan et al. | |
| 7,195,453 | B2 | 3/2007 | Martin et al. | |
| 7,413,400 | B2 | 8/2008 | Barnett | |
| 7,494,316 | B2 | 2/2009 | Barnett et al. | |
| 7,530,782 | B2 | 5/2009 | Barnett et al. | |
| 7,628,578 | B2 | 12/2009 | Barnett et al. | |
| 7,637,718 | B2 * | 12/2009 | Barnett et al. | 415/119 |
| 8,100,634 | B2 | 1/2012 | Evans | |
| 8,182,213 | B2 | 5/2012 | Cheung | |
| 8,206,100 | B2 | 6/2012 | Schuler et al. | |
| 2002/0154991 | A1 | 10/2002 | Bowen | |
| 2005/0022501 | A1 | 2/2005 | Eleftheriou et al. | |
| 2005/0109013 | A1 | 5/2005 | Eleftheriou et al. | |
| 2007/0098548 | A1 | 5/2007 | Barnett et al. | |
| 2009/0004000 | A1 * | 1/2009 | Baumhauer et al. | 415/209.3 |
| 2010/0092281 | A1 | 4/2010 | Habarou et al. | |
| 2010/0111678 | A1 | 5/2010 | Habarou et al. | |
| 2010/0272565 | A1 * | 10/2010 | Cheung | 415/208.2 |
| 2011/0052383 | A1 * | 3/2011 | Lussier | 415/200 |
| 2012/0082553 | A1 | 4/2012 | Eleftheriou et al. | |
| 2012/0082556 | A1 | 4/2012 | Macchia et al. | |

FOREIGN PATENT DOCUMENTS

| | | |
|---|---|---|
| EP | 1790827 | 4/2009 |
| FR | 1583838 | 12/1969 |
| GB | 572859 | 10/1945 |
| GB | 599391 | 3/1948 |
| GB | 2427900 | 1/2007 |
| JP | 59-18006 | 10/1984 |
| JP | 2004-197622 | 7/2004 |
| WO | 2005/012696 | 2/2005 |
| WO | 2007/030921 | 3/2007 |
| WO | 2007/030925 | 3/2007 |
| WO | 2007/030926 | 3/2007 |
| WO | 2007/030929 | 3/2007 |

* cited by examiner

APPARATUS AND METHOD FOR GAS TURBINE ENGINE VANE RETENTION

TECHNICAL FIELD

The described subject matter relates generally to gas turbine engines, and more particularly to vane retention provided therein.

BACKGROUND OF THE ART

Gas turbine engine vane assemblies, such as those provided downstream of the engine fan, may have slots defined through the outer engine case for receiving and retaining the outer ends of the vanes in place. A grommet may be inserted in the slots to surround and isolate the vane from the shroud. However, during a foreign object damage event, a damaged vane can cut the grommet and damage to other surrounding components. An adhesive such as a potting compound is sometimes used, either in conjunction with or in replacement of the grommet, but the use of such an adhesive generally complicates the installation and replacement of vanes. Existing vane retention systems also tend to be heavy and thus negatively affecting the engine's performance.

Accordingly, there is a need to provide improvement.

SUMMARY

In one aspect, the described subject matter provides a vane assembly of a gas turbine engine comprising an annular casing having a series of circumferentially spaced openings defined therethrough; a plurality of circumferentially spaced vanes extending radially inwardly from the casing, an outer end of the respective vanes projecting radially outwardly from the casing through the respective openings, and an inner end of the vanes mounted to an inner portion of the casing; an elastomeric ring surrounding a circumferential outer surface of the casing, the elastomeric ring having a plurality of apertures in registry with the openings, each aperture receiving the projected outer end of a respective vane; and a strap of a non-metallic material extending around an outer periphery of the elastomeric ring and positioned to surround the projecting vane ends, the strap having metallic connectors configured to releasably engage one another, the strap being under circumferential tension when the connectors are mutually engaged, the strap in tension compressing the elastomeric ring against the circumferential outer surface of the casing and biasing the vanes radially towards the inner portion of the casing.

In another aspect, the present invention provides a vane assembly for a gas turbine engine having an outer casing surrounding rotating blades of a rotor, the vane assembly comprising a tubular wall portion of the outer casing located downstream of the rotating blades, the wall portion having a series of circumferentially spaced openings defined therethrough; an inner shroud located inwardly and concentrically with the wall portion, the inner shroud and the wall portion in combination defining an annular flow path therebetween; a vane corresponding to each of the openings, radially extending between the wall portion and the inner shroud, an inner end of the vane being engaged with the inner shroud and an outer end of the vane being received in a corresponding one of the openings, the outer end of the vane projecting radially outwardly from an outer surface of the wall portion; an elastomeric ring surrounding the tubular wall portion, the elastomeric ring having a plurality of apertures each receiving the projected outer end of the respective vane; and a removable strap of a non-metallic material placed in a pre-tensioned condition around the elastomeric ring and against a circumferential outer surface of the tubular wall portion, the removable strap compressing the elastomeric ring and the outer ends of the respective vanes.

In a further aspect, the present invention provides a rotor assembly of a gas turbine engine comprising rotating blades; an annular outer casing having a series of circumferentially spaced apart openings defined therethrough; an inner shroud located inwardly concentric with the outer casing and downstream of the rotating blades, the inner shroud and the outer casing in combination defining an annular flow path therebetween; a vane corresponding to each of the openings, radially extending between the outer casing and the inner shroud, an inner end of the vane being engaged with the inner shroud and an outer end of the vane being received in a corresponding one of the openings, the outer end of the vane projecting radially outwardly from an outer surface of the outer casing; an elastomeric ring surrounding the outer ring, the elastomeric ring having a plurality of grommets each receiving the projected outer end of the respective vanes; and a strap of a non-metallic woven fabric having at least one pair of metallic connectors integrated with the strap, the strap forming a loop placed in a pre-tensioned condition around the elastomeric ring and against the outer surface of the outer casing when the paired connectors are releasably engaged with each other, the pre-tensioned strap radially compressing the elastomeric ring and outer ends of the respective vanes.

Further details of these and other aspects of the described subject matter will be apparent from the detailed description and drawings included below.

BRIEF DESCRIPTION OF THE DRAWINGS

Reference is now made to the accompanying drawings depicting aspects of the described subject matter, in which.

DETAILED DESCRIPTION

Figure 1:
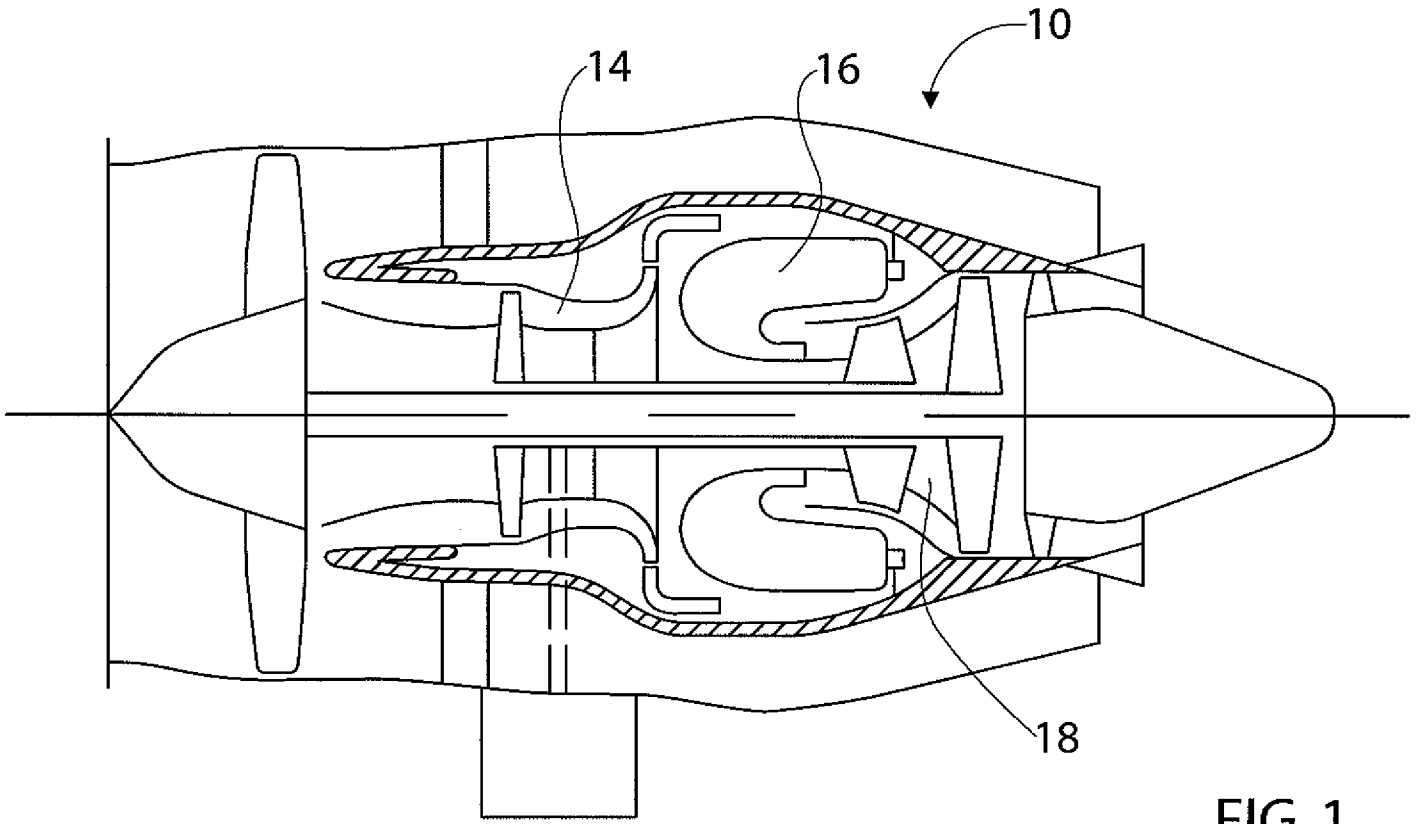
FIG. 1 is a schematic illustration of a cross-sectional view of a gas turbine engine.

FIG. 1 illustrates a gas turbine engine which is taken as an exemplary application of the described subject matter. A gas turbine engine 10 generally comprises in serial flow communication, a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
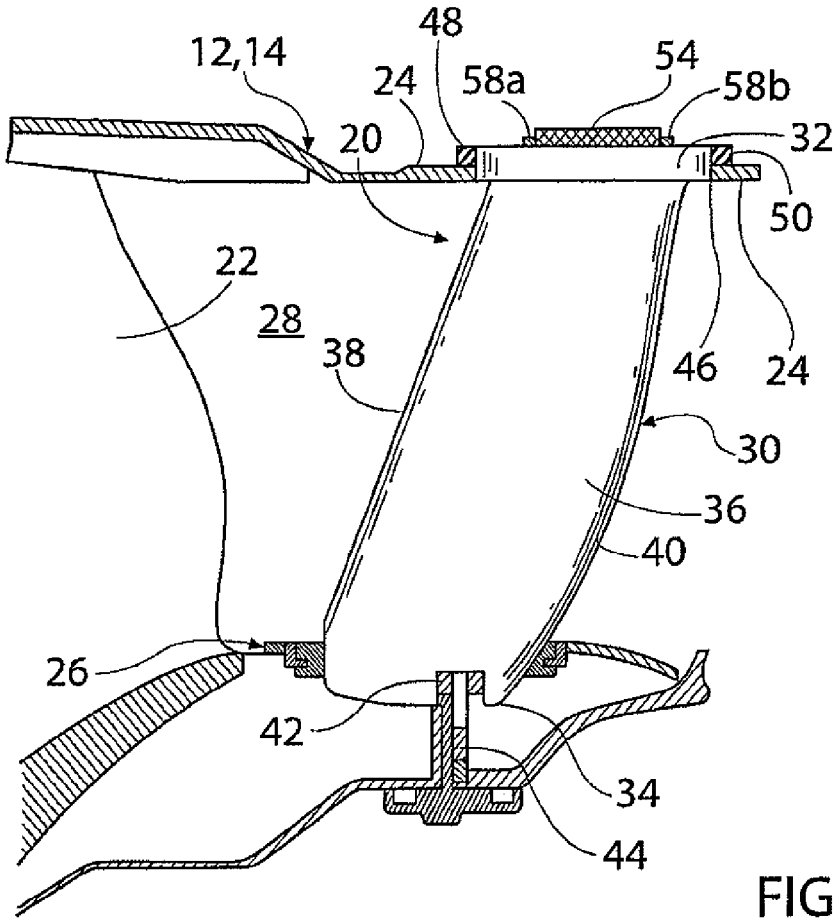
FIG. 2 is a side cross-sectional view of a guide vane assembly according to a particular embodiment, within a gas turbine engine such as that shown in FIG. 1.

Referring to FIG. 2, a rotor assembly, which can be, for example the fan 12 or a low pressure compressor of the compressor section 14 (both shown in FIG. 1), includes rotating blades 22 which are surrounded by an engine casing 24. The casing 24 includes a tubular wall portion (not numbered) extending downstream of the blades 22 to form part of a vane assembly 20. The vane assembly 20 comprises an inner shroud 26 concentric with the casing 24 and located downstream of the rotating blades 22, the inner shroud 26 and casing 24 in combination defining the annular gas flow path 28 therebetween, and a plurality of vanes 30 extending radially between the outer casing 24 and the inner shroud 26 downstream of the rotor blades 22. Each of the vanes 30 has a radial outer end portion forming a vane root 32 retained in the casing 24, a radial inner end forming a vane tip 34 retained in the inner shroud 26, and an airfoil portion 36 extending therebetween. The airfoil portion 36 of each vane 30 defines a relatively sharp leading edge 38 and a relatively sharp trailing edge 40, such that an airflow coming through the blades 22 and passing through the vane assembly 20 will flow over the vane airfoil 36 from the leading edge 38 to the trailing edge 40.

Throughout this description, the axial, radial and circumferential directions are defined respectively with respect to the central axis, radius and circumference of the engine 10.

The vane tip 34 may include a generally rectangular slot 42 extending radially into the airfoil 36 between the leading and trailing edges 38, 40, in order to engage a corresponding web 44 of the inner shroud 26, as disclosed in U.S. Pat. No. 7,413,400, the full description of which is incorporated herein by reference. Alternatively, the vane tip 34 can have any other configuration suitable for engagement with the inner shroud 26.

The outer casing 24 has a series of circumferentially spaced openings 46 defined, for example through the wall portion downstream of the rotating blades 22 of the rotor assembly. Each of the openings 46 has a profile similar to but slightly larger than the vane root 32 such that the vane root 32 is loosely received in the opening 46 and radially and outwardly projects from the outer surface of the outer casing 24.

Figure 3:
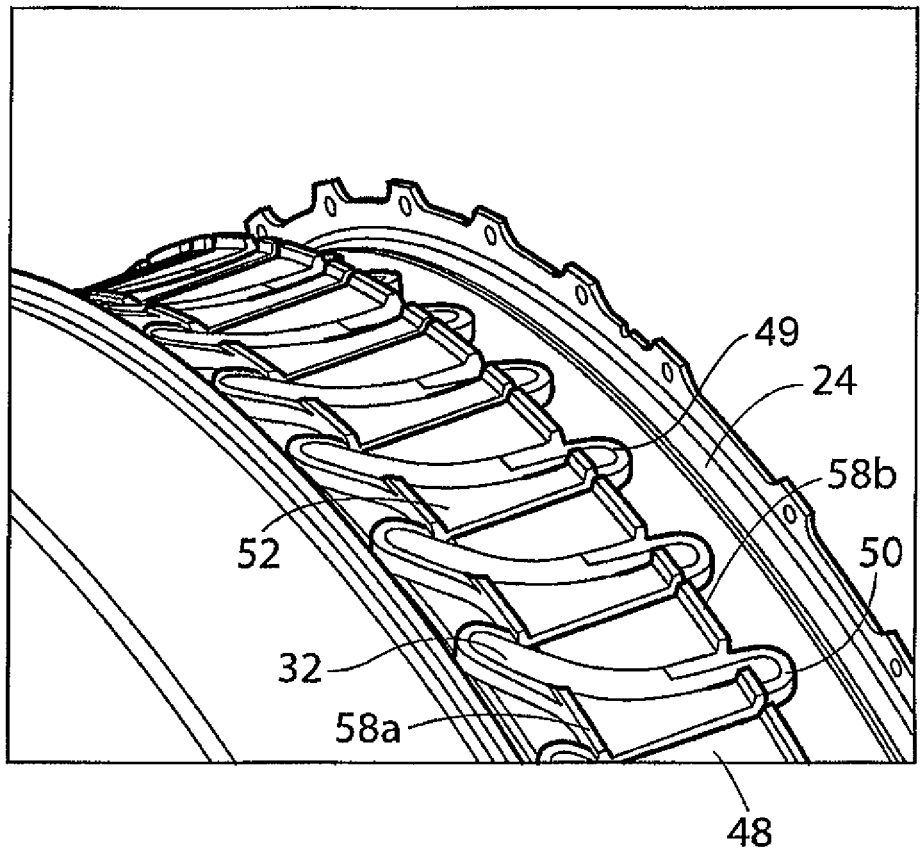
FIG. 3 is a partial perspective view of the vane assembly of FIG. 2, prior to installation of a retaining strap.
Figure 4:
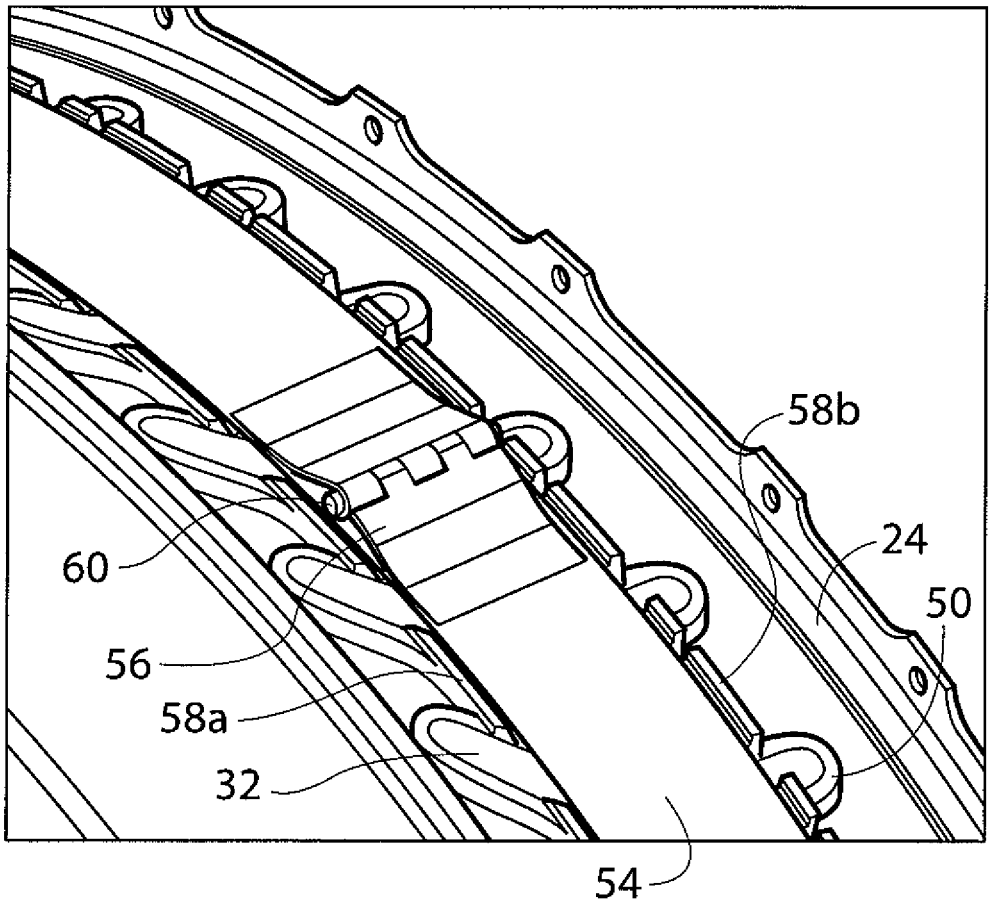
FIG. 4 is a partial perspective view of a vane assembly similar to that of FIG. 3 with the retaining and damping strap installed.

Referring now to FIGS. 2-4, the vane assembly 20 according to this embodiment further includes an elastomeric ring 48 which, for example may be made of rubber, surrounding the outer casing 24. The elastomeric ring 48 includes a plurality of apertures 49 (see FIG. 3) which may be defined by respective grommets 50 according to this embodiment. Each grommet 50 is in registry with a corresponding opening 46 and receives an outer end of the vane 30 which is the vane root 32 in this embodiment, projecting from the outer casing 24. Each grommet 50 has a profile similar to the respective vane root 32 and is sized such that each of the grommets 50 tightly surrounds the periphery of the vane root 32. Adjacent grommets 50 may be interconnected by respective circumferential web portions 52, forming the elastomeric ring 48. Therefore, the outer end of each of the vanes 30 is held in position by the elastomeric ring 48.

A removable strap 54 of a non-metallic material which in this embodiment, may be manufactured from a high strength woven fabric such as Kevlar®, is placed in a pre-tensioned condition around the elastomeric ring 48 to compress the elastomeric ring 48 against the circumferential outer surface of the outer casing 24 (see FIG. 4). The strap 54 may be provided with a pair of metallic connectors 56 connected to the strap 54. The connectors 56 attached to the strap 54 are adapted to slightly shorten the circumference of the loop formed by the strap 54 when the connectors 56 are releasably engaged with each other, thereby creating the pre-tensioned condition of the strap 54 and locking the strap 54 in such a tensioned condition around the elastomeric ring 48.

The strap 54 of woven fabric may be manufactured as an endless loop and the connectors 56 may be integrated with the woven fabric during a weaving procedure. Alternatively, the strap 54 of woven fabric may be manufactured as a strap having opposite ends with the respective connectors 56 integrated with the opposite ends of the strap 54 during the weaving procedure. Therefore the strap 54 forms an endless loop only when the connectors 56 releasably engage each other.

Optionally, the elastomeric ring 48 may include a plurality of positioning elements 58*a* and 58*b* aligning in two circumferential lines, as shown in FIGS. 3 and 4. The positioning elements 58*a* and 58*b* are axially spaced apart by a distance slightly greater than the width of the strap 54, and radially outwardly project from an outer surface of the elastomeric ring 48, thereby axially restraining the strap 54 therebetween when the strap 54 is placed around the elastomeric ring 48, as shown in FIG. 4.

Optionally, the elastomeric ring 48 including grommets 50 and the circumferential web portions 52 except for the positioning elements 58*a* and 58*b*, has a thickness substantially equal to the thickness of the grommets 50 such that the vane root 32 received within the respective grommet 50 is substantially flush with the outer surface of the elastomeric ring 48. Therefore, the pre-tensioned strap 54 not only provides a radial tension to the elastomeric ring 48, particularly to the grommets 50 against the circumferential outer surface of the tubular wall of the outer casing 24, but also provides radial retention of the vanes 30 during a normal engine operation and during a bird strike event. Furthermore, the structural flexibility of the strap 54 of woven fabric in combination with the grommets 50 of the elastomeric ring 48, provides dynamic damping of the vanes to reduce or eliminate vane vibration during engine operation.

Optionally, the pair of connectors 56 may include an apparatus for incrementally adjusting the pre-tensioned condition of the strap 54. For example, each of the paired connectors 56 may have mating hooks or apertures to be lined up to overlap each other, in order to receive a pin 60, as shown in FIG. 4, similar to a hinge structure. The pin 60 may be selected from a group of graded pins having different diameters. The largest diameter of the pin 60 is substantially equal to the opening formed by the overlapped hooks or openings of the respective connectors 56, which locks the connectors 56 in tight connection in order to provide a maximum circumferential tension load to the strap 54. A pin 60 having a smaller diameter which is inserted into relatively oversized hooks or apertures of the connectors, will provide a looser connection of the two connectors 56, thereby providing less circumferential tension load to the strap 54.

Alternatively, the strap 54 of woven fabric may be provided with a plurality of pairs of connectors 56. The pairs of connectors 56 are evenly spaced apart one pair from another in a circumferential direction of the strap 54, and are integrated with the strap 54 during a weaving procedure of the strap 54. The two connectors 56 in each pair are releasably engagable with each other and each pair of connectors is adapted to apply a circumferential tension force to the strap 54 by slightly shortening the circumference of the strap 54. The multiple pairs of connectors 56 allow the circumferential tension forces to be introduced to the strap 54 at more than one location around the circumference of the strap 54, thereby providing an evenly distributed pre-tensioned condition to the strap 54.

Alternatively, the strap 54 of woven fabric may be coated or impregnated with silicon or Teflon® (polytetrafluoroethylene) in order to prevent water absorption and to further facilitate strap movement over the elastomeric ring 48 for equalizing circumferential load distribution. The coating or impregnating procedure may be conducted on the material prior to or after the weaving procedure.

Figure 5:
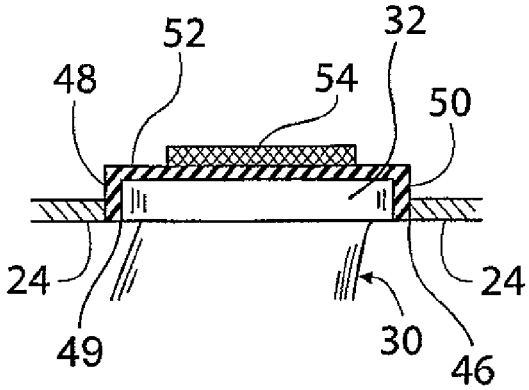
FIG. 5 is a partial side cross-sectional view of a guide vane assembly similar to that of FIG. 2, showing an alternative structure thereof.

Also alternatively, the grommets 50 may have a thickness greater than the thickness of the circumferential web portions 52. Each of the grommets 50 radially extends into an annulus defined between the vane root 32 and the opening 46 as shown in FIG. 5.

As a further alternative, the opening defined by each of the grommets 50 may be closed at the radial outer end thereof by a portion of the elastomeric ring 48, for example may be closed by an extension part of the adjacent web portion 52. The outer end of the vane 30 (vane root 32) is received within the aperture 49 (see FIG. 5) defined by the closed grommet 48 and thus the radial retention of the outer end of the vane 30 provided by the strap 54, is not by direct contact therebetween, but through the cover layer of grommet opening integrated with the entire elastomeric ring 48, as shown in FIG. 5. In this embodiment, the grommet 50 may be inserted into the opening 46 defined in the outer casing 24. Alternatively, the grommet 50 may be placed on the outer surface of the outer surface of the outer casing 24 rather than extending into the opening 46 of the outer casing 24, as shown in FIG. 2.

In comparison to the conventional metallic strap used for radially retaining outer ends of vanes in a vane assembly, the non-metallic strap 54 as above-described in combination with the elastomeric ring, provides a light-weight apparatus for a similar or higher stress retaining apparatus, which evenly distributes the load to the outer casing.

The above description is meant to be exemplary only, and one skilled in the art will recognize that changes may be made to the embodiments described without departure from the scope of the described subject matter. For example, a turbofan gas turbine engine is illustrated in the accompanying drawings as an exemplary application, however it should be understood that the described subject matter may also be applicable to engines of other types. The vane assembly in the above described embodiments need not be limited to the described configurations. The described subject matter may be combined with other configurations of vane assemblies of a gas turbine engines. Still other modifications which fall within the scope of the present invention will be apparent to those skilled in the art, in light of a review of this disclosure, and such modifications are intended to fall within the appended claims.

The invention claimed is:

1. A vane assembly of a gas turbine engine comprising:

an annular casing having a series of circumferentially spaced openings defined therethrough;

a plurality of circumferentially spaced vanes extending radially inwardly from the casing, an outer end of the respective vanes projecting radially outwardly from the casing through the respective openings, and an inner end of the vanes mounted to an inner portion of the casing;

an elastomeric ring surrounding a circumferential outer surface of the casing, the elastomeric ring having a plurality of apertures in registry with the openings, each aperture receiving the projected outer end of a respective and vane;

a strap of a non-metallic material extending around an outer periphery of the elastomeric ring and positioned to surround the projecting vane ends, the strap having metallic connectors configured to releasably engage one another, the strap being under circumferential tension when the connectors are mutually engaged, the strap in tension compressing the elastomeric ring against the circumferential outer surface of the casing and biasing the vanes radially towards the inner portion of the casing; and wherein the connectors include an apparatus for incrementally adjusting tension in the strap.

2. The vane assembly as defined in claim 1, wherein the strap is a woven fabric.

3. The vane assembly as defined in claim 2, wherein the respective connectors are integrated with the strap during a weaving procedure of the strap.

4. The vane assembly as defined in claim 1, wherein the strap comprises a plurality of pairs of said metallic connectors, the plurality of pairs of metallic connectors being evenly spaced apart along the strap.

5. The vane assembly as defined in claim 1, wherein the strap is a woven fabric coated with polytetrafluoroethylene or silicon.

6. The vane assembly as defined in claim 1 wherein the apparatus includes a set of graded pins of varying diameters and oversized mating holes on the respective connectors, and wherein said tension in the strap is determined by which one of the set of graded pins is inserted into the mating holes of the connectors.

7. The vane assembly as defined in claim 1, wherein the elastomeric ring comprises a plurality of grommets interconnected by respective web portions, the grommets defining the respective apertures of the strap.

8. The vane assembly as defined in claim 1, wherein the elastomeric ring comprises a plurality of positioning elements for restraining the strap in an axial movement relative to the elastomeric ring.

9. The vane assembly as defined in claim 1, wherein the projected outer ends of the vanes extend radially through the respective apertures and are substantially flush with an outer surface of the elastomeric ring, the outer ends of the vanes being radially compressed together with the elastomeric ring by the pre-tensioned strap.

10. A vane assembly for a gas turbine engine having an outer casing surrounding rotating blades of a rotor, the vane assembly comprising:

a tubular wall portion of the outer casing located downstream of the rotating blades, the wall portion having a series of circumferentially spaced openings defined therethrough;

an inner shroud located inwardly and concentrically with the wall portion, the inner shroud and the wall portion in combination defining an annular flow path therebetween;

a vane corresponding to each of the openings, radially extending between the wall portion and the inner shroud, an inner end of the vane being engaged with the inner shroud and an outer end of the vane being received in a corresponding one of the openings, the outer end of the vane projecting radially outwardly from an outer surface of the wall portion;

an elastomeric ring surrounding the tubular wall portion, the elastomeric ring having a plurality of apertures each receiving the projected outer end of the respective vane; and a removable strap of a non-metallic material placed in a pre-tensioned condition around the elastomeric ring and against a circumferential outer surface of the tubular wall portion, the removable strap compressing the elastomeric ring and the outer ends of the respective vanes, wherein the strap comprises a pair of metallic connectors to releasably engage one another, the connectors including a set of graded pins of varying diameters for selective insertion into oversized mating holes on the respective connectors, to thereby adjust tension created in the strap.

11. The vane assembly as defined in claim 10 wherein the elastomeric ring comprises a plurality of grommets interconnected by respective web portions, the grommets defining the respective apertures of the elastomeric ring.

12. The vane assembly as defined in claim 10 wherein the grommets have a thickness greater than a thickness of the web portions, each of the grommets radially extending into an annulus defined between one of the vane outer ends and one of the openings.

13. A rotor assembly of a gas turbine engine comprising:

rotating blades;

an annular outer casing having a series of circumferentially spaced apart openings defined therethrough;

an inner shroud located inwardly concentric with the outer casing and downstream of the rotating blades, the inner shroud and the outer casing in combination defining an annular flow path therebetween;

a vane corresponding to each of the openings, radially extending between the outer casing and the inner shroud, an inner end of the vane being engaged with the inner shroud and an outer end of the vane being received in a corresponding one of the openings, the outer end of the vane projecting radially outwardly from an outer surface of the outer casing;

an elastomeric ring surrounding the outer ring, the elastomeric ring having a plurality of grommets each receiving the projected outer end of the respective vanes; and a strap of a non-metallic woven fabric having at least one pair of metallic connectors integrated with the strap, the strap forming a loop placed in a pre-tensioned condition around the elastomeric ring and against the outer surface of the outer casing when the paired connectors are releasably engaged with each other, the pre-tensioned strap radially compressing the elastomeric ring and outer ends of the respective vanes, wherein the connectors include means for adjusting the pre-tensioned condition of the strap.

14. The rotor assembly as defined in claim 13, wherein the strap is a woven fabric coated with polytetrafluoroethylene or silicon.

15. The rotor assembly as defined in claim 13, wherein the outer ends of the respective vanes are flush with an outer surface of the elastomeric ring, the outer surface of the elastomeric ring bearing the pre-tensioned strap.

16. The rotor assembly as defined in claim 13 wherein the at least one pair of metallic connectors includes a set of graded pins of varying diameters and oversized mating holes on the respective connectors, wherein the pre-tensioned condition is determined by which one of the graded pins is inserted into the oversized mating holes of the connectors.

* * * * *